United States Patent [19]

Acker

[11] 4,004,527

[45] Jan. 25, 1977

[54] APPARATUS FOR CORRECTING THE MUTUAL ORIENTATION OF THE PATTERNS ON TWO LAYERS OF CLOTH

[75] Inventor: Laurent G. Acker, Bischwiller, France

[73] Assignee: Vestra-Union S.A., Paris, France

[22] Filed: Jan. 22, 1976

[21] Appl. No.: 651,597

[30] Foreign Application Priority Data

Jan. 30, 1975 France ..... 75.03638

[52] U.S. Cl. ..... 112/121.14; 26/70; 112/217.1

[51] Int. Cl.[2] ..... D05B 3/00

[58] Field of Search ..... 112/121.14, 121.15, 112/2, 217.1, 217.2, 136, 121.26; 26/70

[56] References Cited

UNITED STATES PATENTS

| | | | |
|---|---|---|---|
| 1,673,821 | 6/1928 | Hinsdale | 26/70 X |
| 2,626,535 | 1/1953 | Owen et al. | 26/70 X |
| 3,023,900 | 3/1962 | Thier | 26/70 X |
| 3,395,658 | 8/1968 | Lee et al. | 112/121.14 |
| 3,712,744 | 1/1973 | Nelson | 26/70 X |

*Primary Examiner*—H. Hampton Hunter
*Attorney, Agent, or Firm*—Young & Thompson

[57] ABSTRACT

The disclosure is of an apparatus comprising a table, means for drawing cloth in two layers along the table, openings in the table and a lamp and mirrors whereby an operator can see the patterns on the under surface of the lower cloth layer with the patterns on the upper surface of the upper cloth layer, a plate to extend between and separate the cloth layers, bars for temporarily clamping the cloth layers on the table, and a carriage carrying a basting machine with a thread cutter and mounted to move transversely to-and-fro.

5 Claims, 2 Drawing Figures

APPARATUS FOR CORRECTING THE MUTUAL ORIENTATION OF THE PATTERNS ON TWO LAYERS OF CLOTH

INTRODUCTION AND BACKGROUND OF THE INVENTION

The present invention relates generally to the field of weaving and the industrial manufacture of apparel and refers more particularly to the correction of the mutual orientation of the patterns of two layers of cloth, especially cloth having squares or stripes or checks or other patterns, and an object of the invention is to provide an improved apparatus for use in correcting the mutual orientation of the patterns on two layers of badly calendered cloth.

The cutting of cloth with square or stripe patterns requires a great deal of care, because, in order for a garment made with such a cloth to present a perfect appearance, it is necessary that the pieces of cloth constituting the garment shall be cut in such a manner that the squares or stripes match one another, for example at the seams of the middle and of the side parts and of the sleeves.

It has, however, been established that when the cloth is not properly prepared, that is to say is not folded on the square with reference to its weft, the matching of the pattern in the transverse direction necessitates, notably after calendering or folding and before the final cutting, adjustments which involve losses of time and militate against mechanisation of the cutting.

According to one known method the previously folded cloth passes along on a table on which the cloth is corrected as necessary by an operator.

However in this known method the cloth is moved upon the table under a certain degree of tension which adds to the friction of the upper layer upon the lower layer, making the operation of correction unduly difficult.

The present invention has a further object to mitigate these disadvantages.

A BRIEF SUMMARY OF THE INVENTION

Basically the invention provides an apparatus for correcting the mutual orientation of the patterns on two layers of badly calendered cloth constituted mainly by a table, a carriage mounted for movements to-and-fro transverse to the table, a basting machine mounted on the carriage, an optical inspection device, clamping bars for clamping the cloth, a separator for extending between the layers of cloth, and means for drawing the cloth along the table.

FURTHER DESCRIPTION AND ADVANTAGE OF THE INVENTION

In one preferred construction the separator for extending between the layers of cloth is constituted by a plate of which the position upon the table can be changed by means of an element, for example a screw, extending through the plate and co-operating with a selected one of a plurality of holes provided in the table, and the plate is preferably pivotable about the said element.

Figure 1:
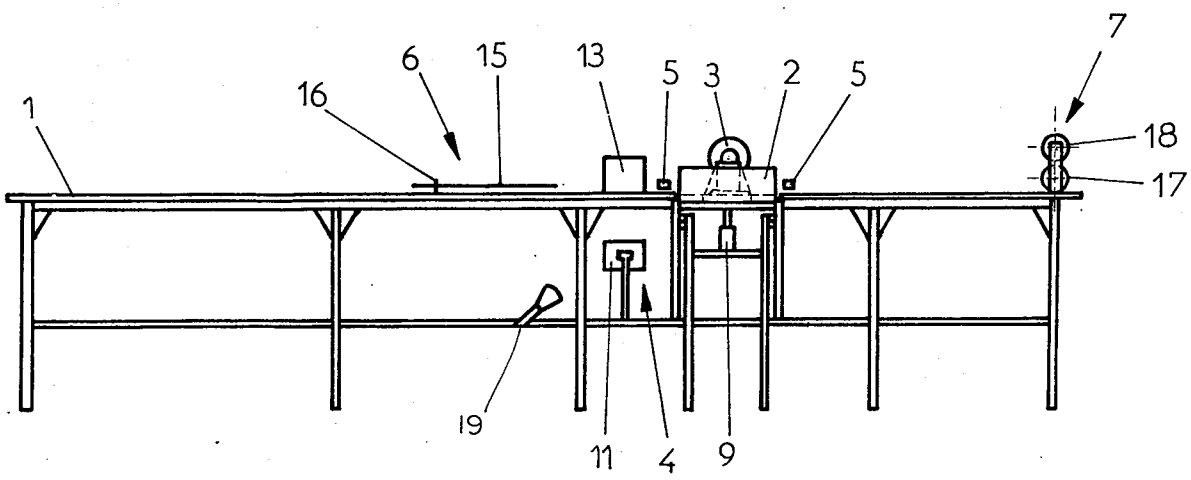
Figure 2:
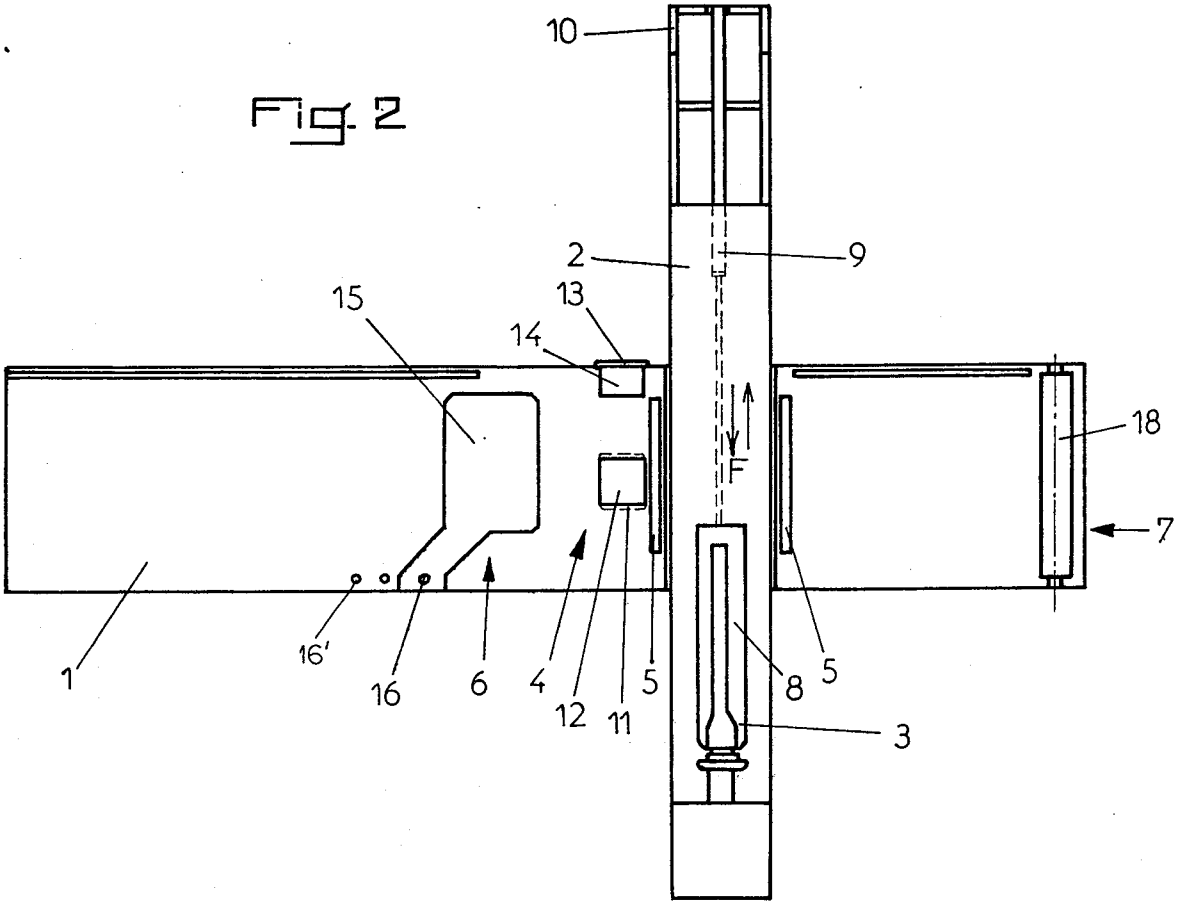

How the invention may be put into practice will be better understood from the following description with reference to the accompanying drawings in which a preferred apparatus in accordance with the invention is illustrated schematically and by way of non-limitative example, FIG. 1 being a side view of the apparatus, and FIG. 2 a plan view of the apparatus.

The apparatus illustrated in the accompanying drawings is in conformity with the invention and is for correcting the mutual orientation of the patterns on two layers of badly calendered cloth, and the apparatus basically comprises a table 1, a transversely movable carriage 2, a basting machine 3, an optical inspection device 4, clamping bars 5 for clamping the cloth, a separator 6 to extend between the layers of cloth, and traction means for drawing the cloth along on the table 1.

The basting machine 3, mounted upon the carriage 2 which is movable transversely of the table 1, is equipped with a thread cutter and has an arm which allows it to extend across the full width of the cloth. The carriage 2 can be moved to-and-fro in the direction of the arrows F by means of a ram 9, of which the cylinder is secured to a support 10 for the carriage 2 and of which the piston rod is connected to the lower part of the carriage 2.

The functioning of the ram 9 and also the movement of the cloth along on the table 1 by means of the traction means 7 are controlled by an operator placed at the side of the carriage 2 and facing a mirror 13. Such control can, of course, equally well be effected automatically in accordance with a predetermined programme.

The optical inspection device 4 comprises a mirror 11 disposed underneath the table 1 and facing towards a central aperture 12 in the table 1 and having an inclination of 45° with respect to the vertical, and further a mirror 13 facing a laterally placed opening 14, the mirror 13 being vertical with respect to the surface of the table 1 and being at the side opposite to that where the operator is placed.

The separator 6 for extending between the layers of cloth comprises a plate 15, for example of metal or of wood or of synthetic plastics material. The position of the plate 15 relative to the table 1 can be adjusted in such a manner that there is favourable guiding of the cloth on the table, the plate 15 being mounted by means of an element 16 such as a screw pillar or the like which extends through the lower part of the plate 15 and co-operates with holes or a selected one of a plurality of holes 16' provided in the table. Moreover the plate 15 is movable by rotation around the screw pillar or other element 16 and permits very easy manipulation of the cloth, since the traction upon the upper layer of cloth has no influence upon that of the lower layer of cloth.

The traction means 7 comprises two independent traction rollers 17 and 18 placed at the end of the table, and the cloth passes between these rollers.

The illustrated apparatus functions in the following manner:

The cloth, entrained between the two rollers 17 and 18 advances along on the table 1 and is stitched longitudinally by the basting machine 3. In the mirror 13 the operator sees the image reflected by the mirror 11 of the pattern passing on the underside of the lower layer of cloth over the central aperture 12. In order to check the correlation of the squares or stripes or other patterns of the two surfaces of the cloth it suffices for the operator to introduce, at a suitable point of the pattern, a needle which extends through the two layers of cloth.

If the correlation is not exact the operator causes the relative displacement of the patterns by shaking the upper layer of cloth until the patterns become perfectly superposed one above the other. The operator then actuates the control for the application of the clamping bars 5 in order to clamp the cloth, the bars 5 being actuated by means of rams or cams or other suitable devices, holding the cloth over the whole width of the table 1 and ensuring good stability of the cloth during the operation of transverse basting. Next the operator actuates the controls for causing the ram 9 to move the carriage 2 with the basting machine 3 in the transverse direction, thus effecting the transverse basting of the length of cloth.

After the transverse basting the carriage 2 with the basting machine 3 returns to its initial position.

Underneath the table 1, in order to permit better visibility, there is provided a lamp 19 which illuminates the under surface of the lower layer of cloth at the position of the central aperture 12.

By means of such an apparatus in conformity with the invention it is very easily possible to correct the mutual orientation of the patterns of badly calendered cloth.

The invention is more particularly applicable for the correlated super-positioning of cloth having in particular patterns of squares or checks.

Naturally the invention is not limited to the manner of construction described with reference to and represented in the accompanying drawings. Modifications remain possible, notably with respect to the construction of the various components, without departing in any way from the scope of protection of the invention as set forth in the appended claims.

What is claimed is:

1. An apparatus for correcting the mutual orientation of the patterns on two layers of badly-calendered cloth, characterised in that it comprises in combination a table having a central aperture, a carriage with means for moving the carriage to-and-fro on a path transverse to the longitudinal direction of the table, a basting machine mounted upon the carriage, an optical inspection device comprising two co-operating mirrors with one of said mirrors being placed below the said central aperture at an angle of 45° to the vertical and the other of said mirrors being placed vertically with respect to the table surface and facing a laterally-placed opening in the margin of the table at the side opposite to an operator's position whereby the operator can view the patterns of the two layers of cloth and the relative positions thereof, clamping bars for temporarily clamping the cloth, a separator to extend between the two layers of cloth, and means comprising two traction rollers for drawing the cloth along on the table.

2. An apparatus as claimed in claim 1, wherein the said separator comprises a plate and adjustable support means carrying the plate.

3. An apparatus as claimed in claim 2, wherein the said adjustable support means comprises a screw pillar extending through the plate and co-operating with any selected one of a plurality of holes in the table to allow the position of the plate relative to the table to be changed, the plate also being pivotable about the screw pillar.

4. An apparatus as claimed in claim 1 wherein the said means for moving the carriage comprises a ram.

5. An apparatus as claimed in claim 1 comprising a lamp illuminating the under surface of the lower layer of cloth through the said central aperture.

* * * * *